US005090768A

United States Patent [19]

Re et al.

[11] Patent Number: 5,090,768

[45] Date of Patent: Feb. 25, 1992

[54] CHAISE LOUNGE RECLINER CHAIR

[75] Inventors: Frank M. Re, Holyoke; James O. Williams, Munson, both of Mass.

[73] Assignee: The Berkline Corporation, Morristown, Tenn.

[21] Appl. No.: 731,387

[22] Filed: Jul. 17, 1991

Related U.S. Application Data

[63] Continuation of Ser. No. 563,495, Aug. 7, 1990, abandoned.

[51] Int. Cl.[5] ..... A47C 1/02

[52] U.S. Cl. ..... 297/85; 297/68; 297/75

[58] Field of Search ..... 257/85, 75, 68, 433

[56] References Cited

U.S. PATENT DOCUMENTS

| | | | |
|---|---|---|---|
| 2,774,412 | 12/1956 | Luckhardt | 297/75 |
| 2,871,917 | 2/1959 | Schiephacke | 297/85 |
| 2,914,114 | 11/1959 | Fletcher | 297/75 X |
| 3,537,747 | 11/1970 | Rogers, Jr. | 297/85 |
| 4,674,794 | 6/1987 | Pine | 297/68 X |

*Primary Examiner*—Peter A. Aschenbrenner
*Attorney, Agent, or Firm*—David D. Kaufman

[57] ABSTRACT

A footstool for recliner chairs having a linkage mechanism that is operable by conventional occupant controlled actuating mechanisms. The footstool comprises a base panel and an intermediate panel pivotally interconnected by the linkage mechanism so that when the footstool is extended, the two panels form a substantially uninterrupted leg support surface with the seat of the chair. The chair is thereby converted to a chaise lounge. When the footstool is retracted, the intermediate panel is stored behind the base panel.

4 Claims, 3 Drawing Sheets

CHAISE LOUNGE RECLINER CHAIR

This application is a continuation of application Ser. No. 07/563,495, filed Aug. 7, 1990, now abandoned.

BACKGROUND OF THE INVENTION

This invention relates generally to recliner chairs and, more particularly, to the footstool portion of recliner chairs. More specifically, the invention relates to a footstool which, when fully extended, converts a recliner chair into a chaise lounge.

Recliner chairs are action chairs which are movable to various positions between upright, TV, and full recline positions. Basically, recliner chairs comprise a chair portion, having a seat and a back, and a footstool portion. The details may vary, but there is invariably some form of actuating mechanism or mechanical linkage for moving the chair portion between the upright and various recline positions. Similarly, the footstool portion has a base panel and a mechanical linkage for moving the same between the retracted or upright condition and the extended or full recline condition for supporting the feet and legs of the occupant. The footstool linkage may be mechanically connected to and operated by the chair actuating mechanism, or it may be independently operable by means of a handle or the like. The two linkage mechanisms thus may be considered as separate and independent mechanical devices. Whatever the mechanical arrangement, the described conventional chair-footstool recliner chair has been characterized by a long-recognized problem.

When the footstool of the conventional recliner chair was moved away from the retracted position, there was created a gap or space between the front edge of the seat and the footstool base panel which functions as the actual footrest. The occupant's legs thus were supported primarily at the heels and ankles while portions of the calves and knees were merely bridging over the gap and otherwise unsupported. That type of partial or discontinuous leg support was not always completely comfortable.

An even more serious problem was created by the described gap between the seat and footrest base panel. A hazard existed because children, and even adults, could intentionally or inadvertently fall into the gap and be caught and seriously injured by the footstool as the same was being retracted. The seriousness of this danger was acknowledged by the industry and, in recent years, the footstool mechanisms have been modified to include a restrainer bar or slat designed to prevent entry by persons into the gap. The restrainer slat extends across the gap and in parallelism with the base panel, but it is typically positioned vertically below the extended footstool base panel. Thus, insofar as failing to support the upper leg portions of the occupant, the gap is still present.

There thus exists a need for a footstool which, when extended from the retracted position closes the gap and provides a substantially continuous or uninterrupted support surface for the chair occupant's legs.

BRIEF SUMMARY OF THE INVENTION

The present invention provides a footstool for recliner chairs which, when extended, comprises a section that completely fills the gap heretofore existing in front of the seat and forms a substantially unbroken support surface for the legs of the chair occupant. The footstool of the invention thereby is able to convert the recliner chair into a true chaise lounge.

Briefly, the invention comprises a footstool having an intermediate panel that moves to be substantially flush with the top surface of the seat and the footstool base panel when the footstool is extended, but which nonetheless stores neatly in concealed relationship behind the base panel when the footstool is retracted. The footstool comprises further a novel linkage mechanism having means for storing the intermediate panel in concealed relationship behind the retracted base panel while still enabling the intermediate panel to be padded and upholstered as desired to match the upholstery of the chair and base panel. The invention thereby comprises an attractive addition to the recliner chair as well as providing the desired substantially uninterrupted leg support surface.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

In the present application, the expression "recliner chair" is used in its broadest sense and is meant to include all forms of motion seats capable of reclining, such as, chairs, sofas and loveseats. In the specific embodiment of the recliner chair illustrated and to be described, the footstool is manually operable for movement from the retracted to the extended position by a handle in manner well known in the industry. It should be understood, however, that the invention applies equally to other forms of footstool actuation known to those skilled in the art, such as, those wherein the footstool linkage is connected to and operated by movement of the armrests and seat recliner linkage mechanism, or by release of a stored energy spring mechanism. Moreover, since the particular form of the chair does not per se comprise a part of the invention, only so much thereof as is necessary for an understanding of the invention will be described in detail.

Figure 1:
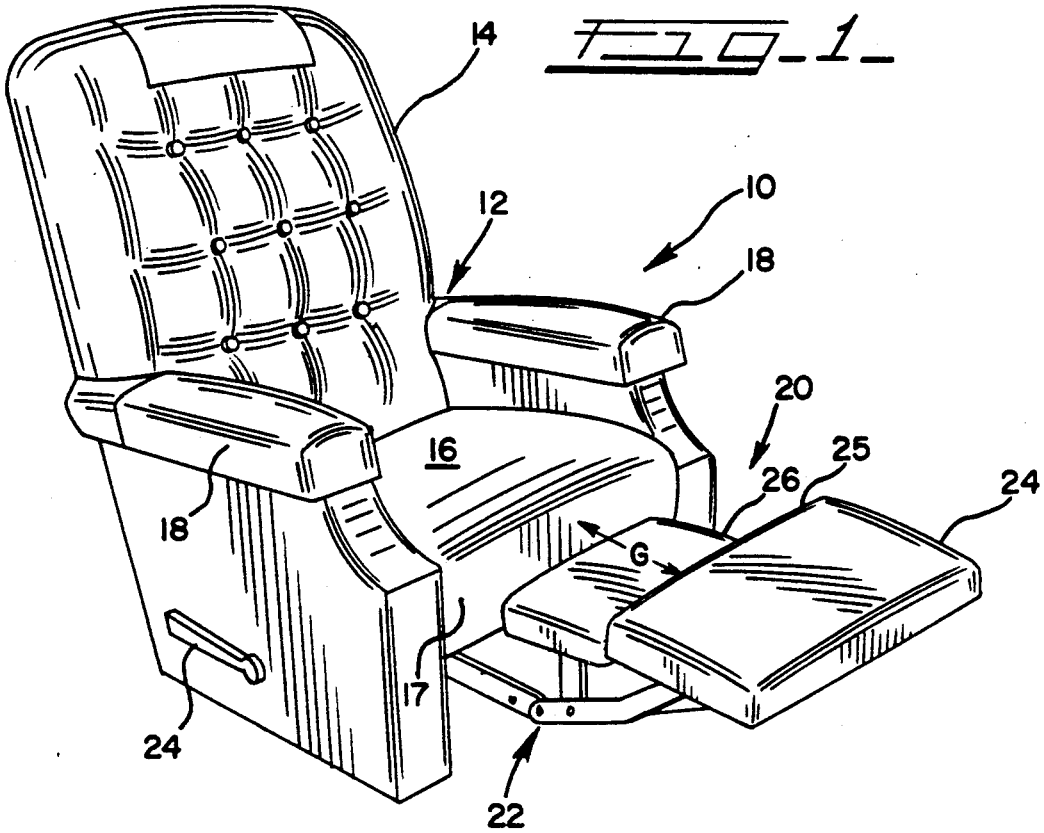
FIG. 1 is a perspective view of a typical prior art recliner chair and showing the same in the intermediate or TV position with the footstool fully extended.

Referring in greater detail to FIG. 1 of the drawings, there is illustrated a conventional recliner chair 10 comprising a chair portion 12, having a back 14 and a seat 16, and arms 18, 18. A footstool portion 20 is operatively associated with the chair 10, said footstool portion comprising a linkage mechanism 22 operable, in this embodiment, by a handle 24. Footstool portion 20 comprises further a footrest base panel 24 and an intermediate or restrainer panel 26 pivotally mounted on the linkage mechanism 22, and said panels are typically padded and upholstered to match the trim and upholstery of the remainder of the chair. It will be noted that the restrainer panel 26 is positioned vertically below the base panel 24 and the top surface of the seat 16. There thus exists a gap G between the front edge 17 of the seat and the rear edge 25 of the base panel when the footstool 20 is in the fully extended position illustrated.

Figure 2:
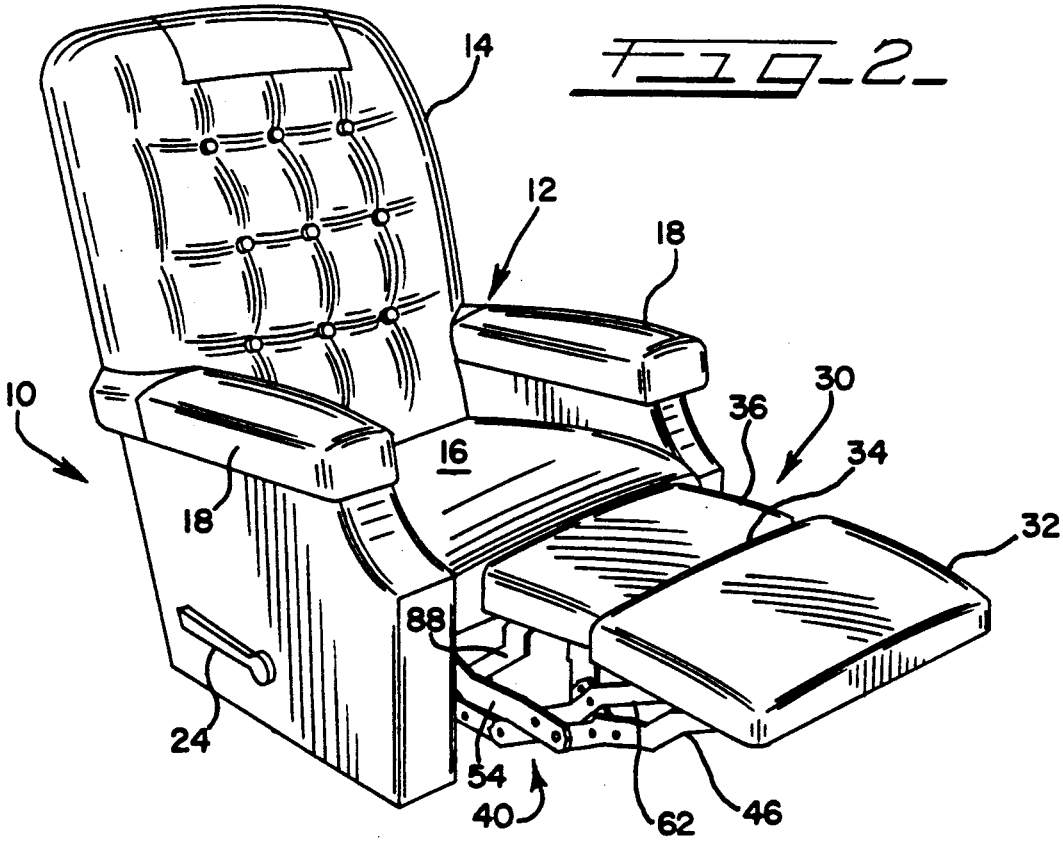
FIG. 2 is a similar view of a recliner chair with a footstool embodying the principles of the invention.

Referring now to FIG. 2 of the drawings, there is illustrated a footstool 30 embodying the principles of the invention. Footstool 30 is shown operatively associated with a typical recliner chair 10 comprising a chair portion 12 having a back 14, a seat 16 having a front edge 17, arms 18, 18, and handle 24 for manually actuating the footstool. Footstool 30 comprises a base panel 32 having a rear edge 34 and an intermediate panel 36, said panels being pivotally mounted on a footstool linkage mechanism 40. When the footstool 30 is fully extended, the intermediate panel 36 effectively adjoins the seat and base panel by filling the space between the front edge 17 of the seat 16 and the rear edge 34 of the base panel, and lies in substantially the same plane as the base panel and the top surface of the seat. Thus, as seen in FIGS. 2 and 3, the extended footstool 30 provides a substantially continuous and uninterrupted support surface for the legs of the chair occupant, thereby converting the chair 10 to a chaise lounge.

Figure 3:
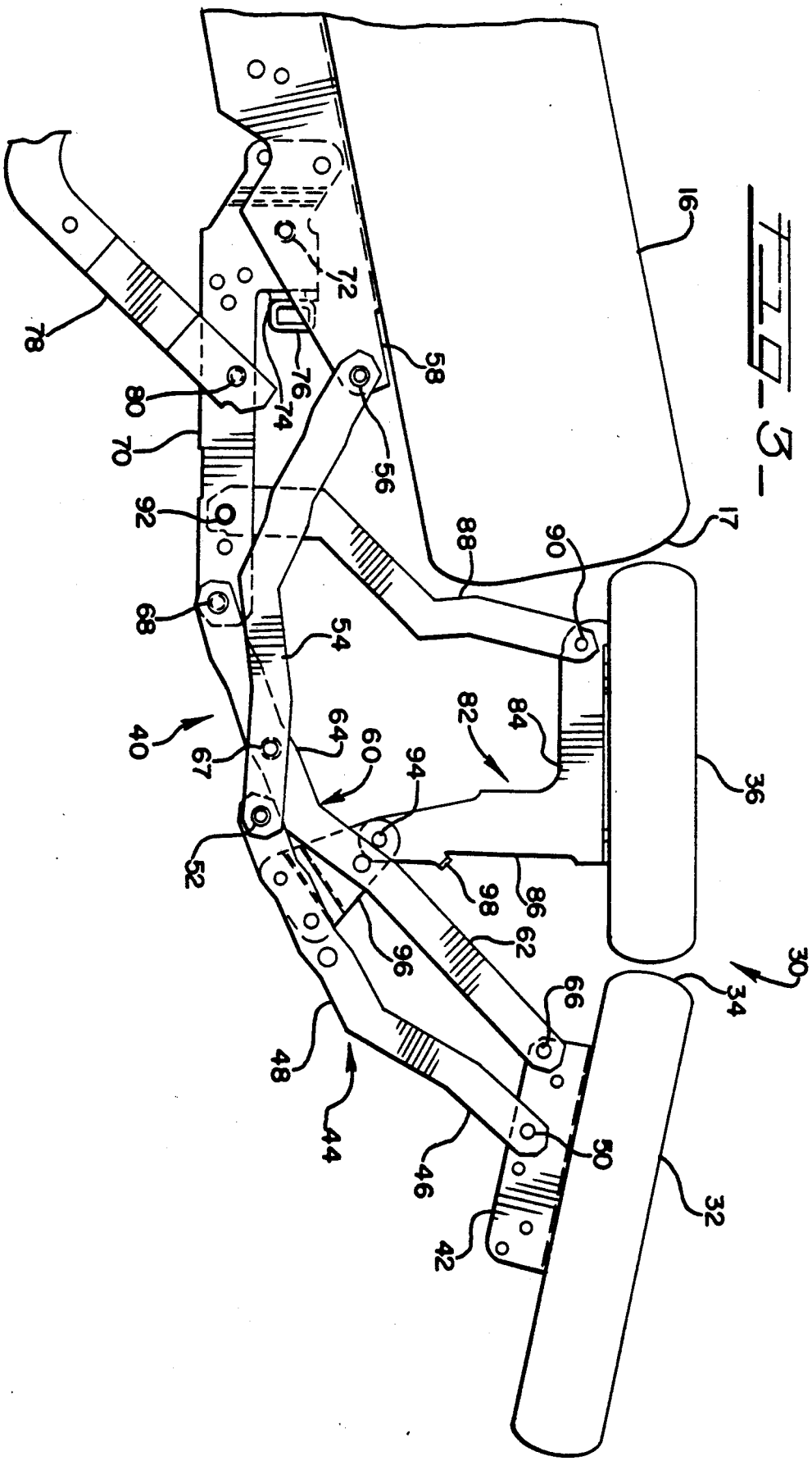
FIG. 3 is an enlarged, fragmentary elevational view seen from the left side of FIG. 2 with the armrest portion of the chair removed.
Figure 4:
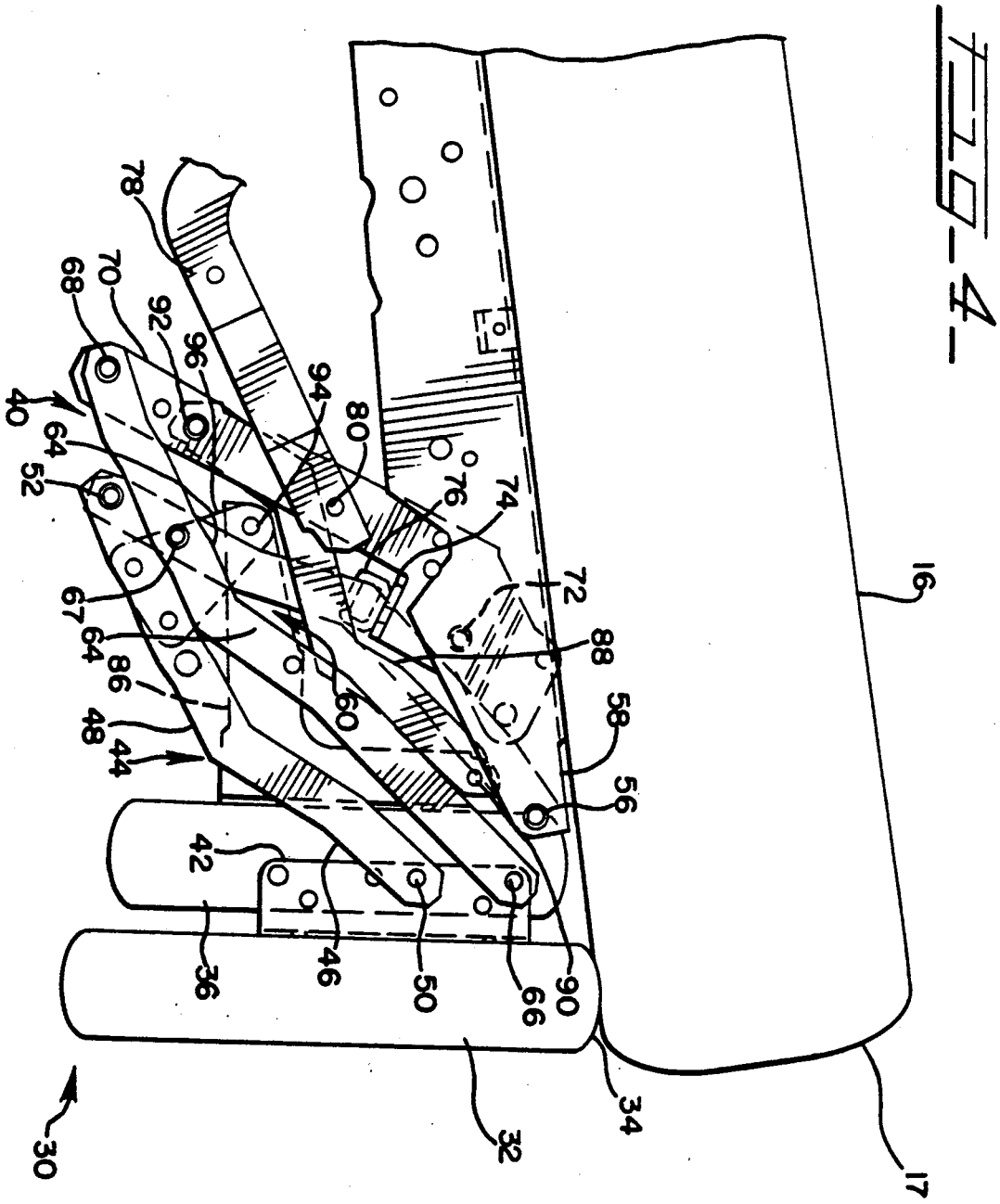
FIG. 4 is a similar view but showing the footstool in the upright or retracted position.

The footstool linkage mechanism 40 illustrated in detail in FIGS. 3 and 4 is present on each side of the chair and footstool 30, although the structure for only one side is shown for purposes of clarity of illustration. It should thus be understood that the linkage mechanism 40 is duplicated on the opposite side of the chair not shown. Footstool linkage mechanism 40 comprises a base panel plate 42 secured to the base panel 32 adjacent a lateral edge thereof. A first footstool link 44, having generally a distal segment 46 and a proximal segment 48, has its distal end pivotally connected at 50 to the base panel plate 42 medially of the length of said plate. The proximal end of link 44 is pivotally connected at 52 to the distal end of a connecting link 54. The opposite end of the connecting link 54 is pivotally connected at 56 to the front edge of a seat mounting plate 58 which depends from and supports the seat 16.

A second footstool link 60, having generally a distal segment 62 and a proximal segment 64, has its distal end pivotally connected at 66 to the plate 42 at the proximal corner of said plate, and its proximal segment pivotally connected at 67 to the connecting link 54. The opposite or proximal end of the link 60 is pivotally connected at 68 to the distal end of a second connecting link 70, and the opposite end of the link 70 is pivotally connected at 72 to the seat mounting plate 58. Second connecting link 70 comprises further a flange 74 to which is rigidly mounted a torque tube 76 whose opposite end is similarly rigidly connected to the opposite side linkage (not shown) and thereby functions as a stretcher to unify and stabilize the footstool linkage 40. A driving link 78 is pivotally connected at 80 medially of the link 70, and said driving link is further operationally connected to the handle or other known footstool actuating mechanisms (not shown) alluded to above.

An intermediate panel link 82 supports the intermediate footstool panel 36. Link 82 is generally L-shaped comprising a foot 84 and a leg 86, and foot 84 is secured to the panel 36 adjacent a lateral edge thereof to provide an intermediate panel plate. An intermediate connecting link 88 is pivotally connected at 90 to the proximal end of the foot 84 and pivotally connected at its opposite end to the connecting link 70 at 92. The end of the leg 86 is pivotally connected at 94 to the apex of a triangular link 96, the base of the triangular link being rigidly connected to the proximal segment 48 of the first footstool link 44. The leg 86 also comprises a stop projection 98 for properly retaining the intermediate panel 36 in the retracted position.

Operation of the footstool linkage mechanism 40 positions the intermediate panel 36 to provide the substantially uninterrupted leg support surface illustrated in FIGS. 2 and 3. Referring to FIG. 4, it is also important to note that the novel linkage mechanism functions to neatly store the intermediate panel behind, and in substantial parallelism with, the base panel 32 when the footstool 30 is in the upright or retracted position. Intermediate panel 36 is slightly narrower than the base panel 32 to permit storage between the opposed base panel plates 42, but may otherwise be fully padded and upholstered to harmonize and fit with the remainder of the chair. Typically, movement of the footstool from the extended position back to the upright position is achieved by the chair occupant applying foot pressure to the base panel and the footstool 30 is operable in the same way, or in any other known manner of operation acting through the driving link 78.

From the foregoing description, it should be apparent that the invention provides a novel footstool which, when extended, eliminates the undesirable gap present in prior footstools and creates a substantially uninterrupted support surface for the legs of the chair occupant. The invention is universally cooperable with various known types of recliner chair mechanisms for effectively converting such chairs into chaise lounges. It should also be understood that the language employed herein, including such expressions as "proximal" and "distal," is for purposes of description rather than limitation, and various changes may be made without departing from the spirit or scope of the invention which defined in the appended claims.

What is claimed is:

1. In a recliner chair having a seat frame and an upholstered seat, and actuation means for operating a footstool between a retracted position and an extended leg-supporting position, a footstool assembly comprising:

an upholstered base panel and a separate upholstered intermediate panel; and a linkage mechanism interconnecting said base and intermediate panels and operationally connected to said actuation means, said linkage mechanism comprising first and second footstool links pivotally connected to said base panel;

first and second connecting links pivotally connected respectively to said first and second footstool links and between said footstool links and the seat frame;

an L-shaped link having a leg and a foot, the foot being rigidly secured to said intermediate panel; and first and second intermediate links pivotally connected respectively to said leg and foot, said intermediate links being connected respectively to said first footstool link and said second connecting link, whereby said base and intermediate panels extend in substantially vertical planes adjacent the front of the chair with said intermediate panel concealed behind said base panel when the footstool is in the retracted position, and said intermediate panel is positioned directly in front of said seat and substantially flush with the seat and base panel to form a substantially uninterrupted leg-supporting surface when the footstool is in the extended position.

2. The recliner chair of claim 1 wherein said first intermediate link is pivotally connected to the end of said leg and rigidly connected to said first footstool link.

3. The recliner chair of claim 2 wherein said first intermediate link is triangular in configuration, the apex of said triangle being pivotally connected to said leg and the base of said triangle being rigidly connected to said first footstool link.

4. The recliner chair of claim 2 wherein said second intermediate link is pivotally connected to the end of said foot and pivotally connected to said second connecting link.

* * * * *